United States Patent [19]

Odermann

[11] 4,395,962

[45] Aug. 2, 1983

[54] STRAIGHT STITCH THROAT PLATE FOR A SEWING MACHINE

[75] Inventor: Charles R. Odermann, Montville, N.J.

[73] Assignee: The Singer Company, Stamford, Conn.

[21] Appl. No.: 304,741

[22] Filed: Sep. 23, 1981

[51] Int. Cl.[3] ..... D05B 73/12

[52] U.S. Cl. ..... 112/260; 112/168

[58] Field of Search ..... 112/168, 260

[56] References Cited

U.S. PATENT DOCUMENTS

| | | | |
|---|---|---|---|
| 2,911,929 | 11/1959 | Caldwell | 112/260 X |
| 3,342,152 | 9/1967 | Rakacs | 112/168 X |
| 3,545,393 | 12/1970 | Meier | 112/260 |
| 3,602,168 | 8/1971 | Yamashita | 112/168 |
| 4,150,633 | 4/1979 | Adams | 112/260 |

FOREIGN PATENT DOCUMENTS

| | | | |
|---|---|---|---|
| 1656992 | 3/1953 | Fed. Rep. of Germany . | |
| 47-14092 | 5/1972 | Japan . | |
| 47-14093 | 5/1972 | Japan . | |
| 47-9653 | 10/1972 | Japan . | |
| 54-102355 | 7/1979 | Japan . | |
| 759057 | 1/1955 | United Kingdom | 112/260 |

*Primary Examiner*—Wm. Carter Reynolds

*Attorney, Agent, or Firm*—William V. Ebs; Robert E. Smith; Edward L. Bell

[57] ABSTRACT

A straight stitch throat plate for a sewing machine is formed as a resilient thin sheet metal part with integral appendages including a depending rear tab which hooks under the edge of a feed dog slot in a zig-zag plate, laterally spaced depending tabs which are received in locator holes in the zig-zag place, and a bent down flange to extend over a front edge of the zig-zag plate into a position wherein the flange may be engaged by a slide plate on the sewing machine.

6 Claims, 4 Drawing Figures

STRAIGHT STITCH THROAT PLATE FOR A SEWING MACHINE

BACKGROUND OF THE INVENTION

1. Field of the Invention

The invention is directed to a straight stitch throat plate which attaches to a zig-zag throat plate in a sewing machine.

2. Description of the Prior Art

Accessories for a sewing machine generally include both a straight stitch throat plate and a zig-zag throat plate. Only straight stitches are sewn with the straight stitch plate. Both straight stitches and zig-zag stitches can be sewn with the zig-zag plate, however, straight stitches are best sewn with the straight stitch throat plate because of the smaller needle hole in such plate and the additional support provided for fabric at the stitching site.

When switching from straight stitching to zig-zag stitching or vice versa, an operator first had to remove the throat plate in the bed of the machine, and then replace it with the appropriate one. This was an inconvenience. Further, the procedure required the use of two different yet almost identical throat plates, each fashioned to mount in the bed of the machine. The plates had to be substantial in construction and were costly items.

It is a prime object of the invention to provide an improved straight stitch throat plate which can be readily attached to and removed from a zig-zag plate, and so does not require an operator to replace a throat plate when changing over from the one type of sewing to another.

It is another object of the invention to provide such an attachable and removable throat plate which can be easily and inexpensively fabricated as a unitary part from sheet metal.

Other objects and advantages of the invention will become apparent during a reading of the specification taken in connection with the accompanying drawings.

SUMMARY OF THE INVENTION

In accordance with the invention, there is provided a thin straight stitch throat plate of sheet metal which attaches to a zig-zag plate in a sewing machine in a manner assuring a fixed position for the straight stitch plate on the machine. The attachable plate is flat except for formed appendages, and the material of the plate is resilient. The attachable plate, near its rear edge includes a small depending tab which hooks under the edge of a feed dog hole in the zig-zag plate. Such attachable plate also includes a pair of laterally spaced depending tabs which are received in locator holes in the zig-zag plate, and a wide bent down front flange to extend over the front edge of the zig-zag plate where it may be engaged by a side plate. A front tab is provided on the straight stitch plate to extend under the slide plate. The straight stitch plate is easily removed from the zig-zag plate with the front tab.

DESCRIPTION OF THE PREFERRED EMBODIMENT

Figure 1:
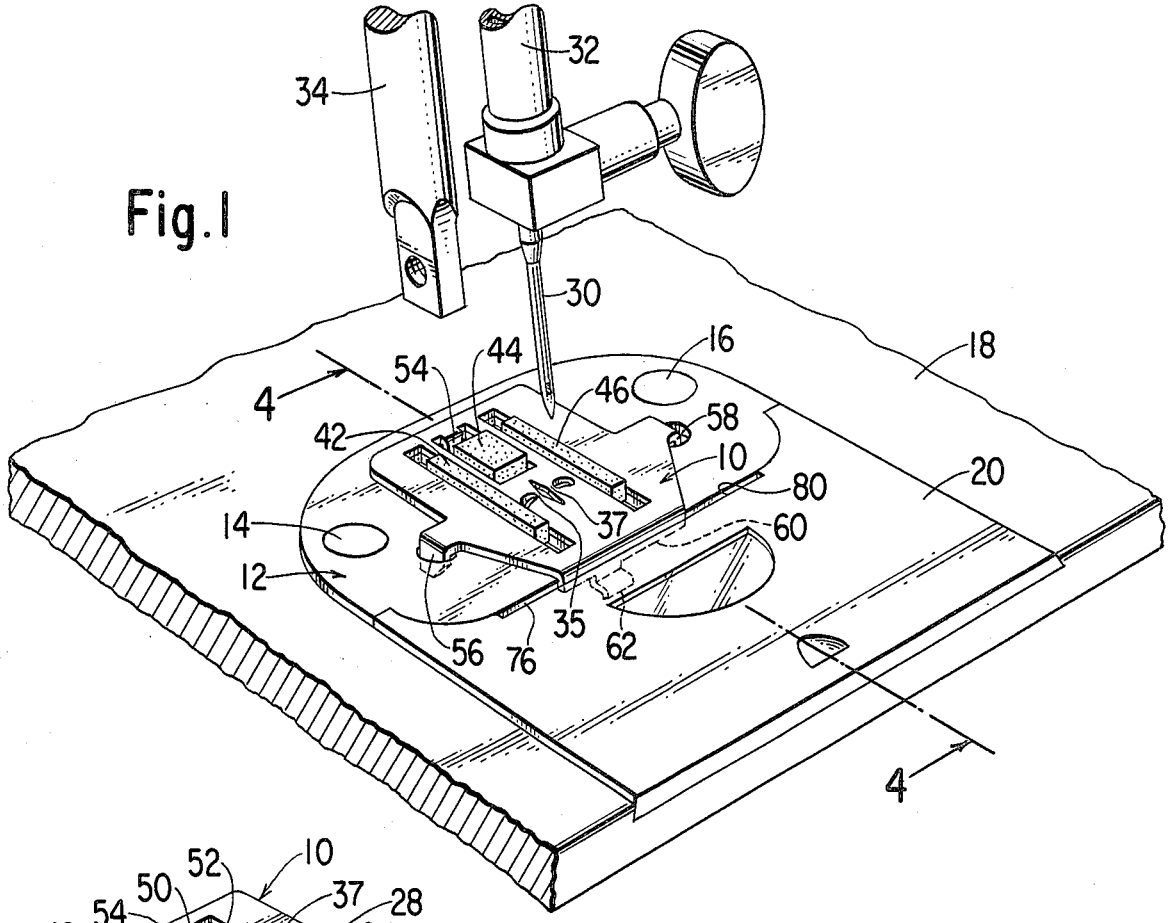
FIG. 1 is a perspective view showing a straight stitch plate according to the invention in an assembled position over a zig-zag plate in a sewing machine.
Figure 2:
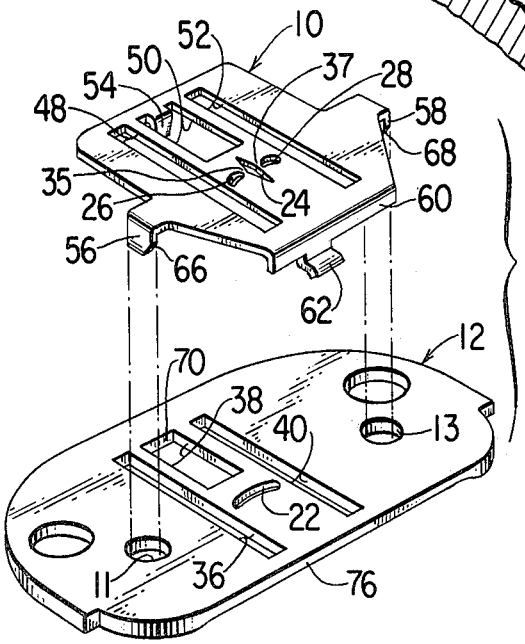
FIG. 2 is an exploded view of the straight stitch and zig-zag plate of FIG. 1.
Figure 3:
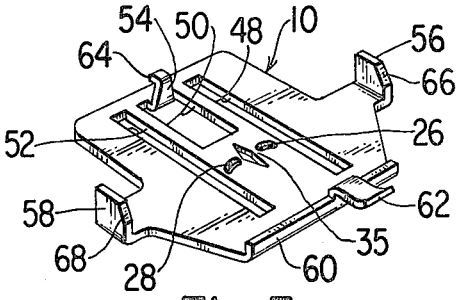
FIG. 3 is a bottom perspective view of the straight stitch plate.
Figure 4:
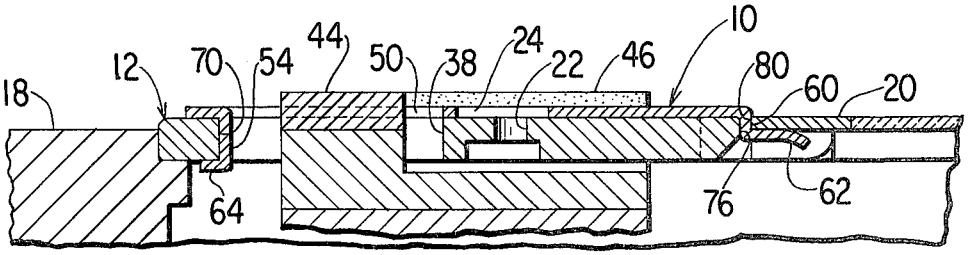
FIG. 4 is a front to rear sectional view taken centrally through the assembled straight stitch and zig-zag plates on the plane of the line 4—4 of FIG. 1.

Referring to the drawings, reference character 10 designates a straight stitch throat plate according to the invention. Such straight stitch throat plate attaches to a zig-zag plate 12 which mounts on pins 14 and 16 in the bed 18 of a sewing machine adjacent to a slide plate 20. The zig-zag plate 12 includes an arcuate opening 22 and laterally spaced locator holes 11 and 13. The straight stitch throat plate includes a central opening 24 which is bracketed by side saftey openings 26 and 28. When the straight stitch throat plate 10 is off the machine, a sewing needle 30 reciprocated into any zig-zag pattern position by a needle bar 32 can pass through opening 22 in plate 12. When the straight stitch throat plate is attached to the zig-zag plate 12, openings 24, 26 and 28 in plate 10 register with the arcuate opening 22 in plate 12 and needle 30 can pass through openings 24 and 22 in plates 10 and 12, respectively, to sew straight stitches in material supported on plate 10 under a presser foot not shown, but connectible to presser bar 34). Side openings 26 and 28 permit the needle to pass through both plates in the event the machine is erroneously instructed to sew any one of a number of pattern stitches when the straight stitch plate is in place over the zig-zag plate and so prevent damage to the needle. Solid portions 35 and 37 of plate 10 between side openings 26 and 38 provide support not present in the zig-zag plate for work during straight stitching and thereby prevent thin fabrics from flagging, that is from being drawn through the plate openings with the needle and causing skipped stitches.

As shown, the zig-zag plate 12 includes slots 36, 38 and 40 for fabric moving feed dog elements 42, 44 and 46, respectively. Plate 10 is provided with slots 4, 50 and 52 which correspond to and are respectively alignable with the slots 36, 38 and 40 in plate 12. It is essential that the straight stitch throat plate 10 be thin and that it lay flat when in place over the zig-zag plate 12 so as not to reduce the effective height of the feed dog elements and thereby prevent the feed dog from moving material on plate 10 as required when sewing. The plate is therefor formed from thin sheet metal. The material of the plate should be resilient, and should exhibit, without having been subjected to a heat treatment process such as might tend to warp the part, a degree of stiffness preventing the plate from being easily bent or otherwise deformed. Stainless sheet steel has the requisite degree of resiliency and stiffness and is especially suited for use in the manufacture of the part. The actual thickness of the sheet metal plate has been much exaggerated in the drawings to better show the part, however, the actual thickness is preferably less than half (0.5) a millimeter.

Plate 10 is flat except for integral appendages which serve to hold the plate in position over zig-zag plate 12. Such appendages include a rear depending tab 54 centrally located with respect to side edges of plate 10, laterally spaced depending side edge tabs 56 and 58, a bent down front edge flange 60, and a front tab 62 extending from flange 60. The appendages are conveniently fashioned in a press when the plate is formed from the sheet metal used for the part. As shown, tab 54 includes a hooked end 64. The tabs 56 and 58 are disposed to enter locator holes 11 and 13 in plate 12 and are tapered by slanted front edges 66 and 68 which assist in the insertion of the tabs in said holes 11 and 13.

Plate 10 is attached to plate 12 by first inserting hooked end 64 of tab 54 under the rear edge 70 of slot 38 in plate 12 and then pivoting the plate 10 about edge 70 to cause side tabs 56 and 58 to enter holes 11 and 13 in zig-zag plate 12, and flange 60 to extend over the front edge 76 of the zig-zag plate. Slide plate 20, which should be in at least a partially open position while plate 10 is being attached to plate 12, is then moved over tab 62 and into a tightly closed position to cause edge 80 of the plate 20 to firmly engage flange 60 as shown in FIG. 1.

In its attached position, the straight stitch throat plate 10 is prevented from moving rearwardly on plate 12 by reason of the engagement of tab 54 with the rear edge 70 of slot 38 in plate 12, and is prevented from moving forwardly by the engagement of flange 60 with edge 80 on plate 20. Lateral movement of plate 10 is prevented by the tabs 56 and 58 in holes 11 and 13. The edge 80 of plate 20 in engagement with the edge flange 60 of plate 10 prevents plate 10 from turning. The straight stitch plate is prevented from becoming detached from the zig-zag plate by the engagement of hooked end 64 of tab 54 with the underside of the zig-zag plate, and by the engagement of tab 62 with the underside of plate 20.

As indicated hereinbefore, it is essential that straight stitch throat plate 10 lay flat on zig-zag plate 12 so as not to interfere with the effectiveness of the feed dog elements in moving material on plate 10 during a sewing operation. The tabs 54 and 62 prevent plate 10 from being moved vertically by up-down motion of the feed dog in the event of accidental engagement of the feed dog elements with the plate, and so assure that plate 10 is maintained in a level position flush against plate 10 during sewing operations.

Although plate 10 may be securely retained in a fixed position on plate 12 in the manner described, the plate 10 can readily be removed from its attached position on plate 12. The slide plate 20 is first slid forwardly, that is toward an operator. The straight stitch throat plate is then lifted with tab 62, and is at the same time pulled forwardly with the tab 62 to cause the side tabs 56 and 58 to slide along their slanted front edges 66 and 68 until out of locator holes 11 and 13. As plate 10 moves forwardly hooked end 64 of tab 54 moves out from under the edge 70 of slot 38 in plate 12, whereupon the plate 10 can be removed from plate 12.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. A straight stitch throat plate attachable to a zig-zag throat plate in a sewing machine, both of the plates being slotted to accommodate feed dog members, and said zig-zag plate including laterally spaced locator holes, said straight stitch throat plate being a thin sheet metal part which is formed from a resilient metal and which is flat except for integral appendages including a depending rear tab which hooks under an edge of a feed dog slot in the zig-zag plate, laterally spaced depending tabs which are received in said locator holes, and a bent down flange to extend over a front edge of the zig-zag plate into a position wherein the flange may be engaged by a slide plate.

2. A straight stitch throat plate as defined in claim 1 wherein said rear tab is centrally located with respect to side edges of the straight stitch plate, and hooks under an edge of a zig-zag plate slot.

3. A straight stitch throat plate as defined in claim 1 wherein said straight stitch throat plate is stainless steel.

4. A straight stitch throat plate as defined in claim 1 including in addition to a needle hole for straight stitching, a safety hole on each side thereof through which a needle may pass if moved to form a zig-zag stitch, and a solid portion of the straight stitch throat plate between the needle hole for straight stitching and each safety hole for the support of material to be sewed.

5. A straight stitch throat plate as defined in claim 1 including a front tab to extend under the slide plate.

6. A straight stitch throat plate as defined in claim 1 wherein the sheet metal of the straight stitch throat plate is less than half a millimeter in thickness.

* * * * *